US005634449A

United States Patent [19]

Matsumoto et al.

[11] Patent Number: 5,634,449

[45] Date of Patent: Jun. 3, 1997

[54] ENGINE AIR-FUEL RATIO CONTROLLER

[75] Inventors: Mikio Matsumoto, Yokohama; Hiroshi Iwano; Yuki Nakajima, both of Yokosuka, all of Japan

[73] Assignee: Nissan Motor Co., Ltd., Kanagawa, Japan

[21] Appl. No.: 616,418

[22] Filed: Mar. 15, 1996

[51] Int. Cl.[6] ..... F02D 41/06

[52] U.S. Cl. ..... 123/491; 123/478

[58] Field of Search ..... 123/478, 480, 123/491

[56] References Cited

U.S. PATENT DOCUMENTS

| | | | |
|---|---|---|---|
| 4,939,658 | 7/1990 | Sekozawa et al. | 123/480 X |
| 5,027,779 | 7/1991 | Nishiyama | 123/491 |
| 5,263,455 | 11/1993 | Iwai et al. | 123/478 |
| 5,404,856 | 4/1995 | Servati | 123/478 |

FOREIGN PATENT DOCUMENTS 7-54689 2/1995 Japan .

*Primary Examiner*—Tony M. Argenbright

*Attorney, Agent, or Firm*—Lowe, Price, LeBlanc & Becker

[57] ABSTRACT

Fuel amounts injected by a fuel injection valve are summed from when an engine is started to when startup is complete. The temperature of a fuel-deposited part during engine startup is estimated, and an intake rate of a fuel injection amount to a combustion chamber is found from this temperature. A fuel deposition amount at completion of startup is estimated from the sum of fuel injection amounts and this intake rate. By increasing or decreasing the fuel injection amount after startup based on this fuel deposition amount, a post startup air-fuel ratio is rapidly stabilized unaffected by scatter of startup time.

4 Claims, 6 Drawing Sheets

ENGINE AIR-FUEL RATIO CONTROLLER

FIELD OF THE INVENTION

This invention relates to engine air-fuel ratio control, and more specifically to engine air-fuel ratio control after start-up is completed.

BACKGROUND OF THE INVENTION

In a fuel injection engine, a basic fuel injection amount is determined according to an intake air amount each time a cylinder performs an intake cycle, and a fuel injection amount is determined by multiplying this basic fuel injection amount by various correction coefficients. Fuel corresponding to this amount is intermittently injected from a fuel injection valve into the intake air in synchronism with the engine rotation.

The aforesaid coefficients comprise a post startup increase coefficient KAS which is determined by the engine cooling water temperature and the time elapsed since completion of startup. When the engine is cold, some of the injected fuel deposits on the wall surfaces of intake passages and intake valves (referred to hereinafter as deposited fuel). Part of the deposited fuel evaporates, but part flows down the walls and through the intake valves into the combustion chamber so as to set up what is referred to as wall flow. For this reason, when the engine is cold, the fuel entering the combustion chamber tends to be delayed, and this delay is compensated by increasing the amount of injected fuel using the post startup increase coefficient KAS.

Immediately after startup is completed, an initial value of KAS is used, and a gradually decreasing value of KAS is applied as the elapsed time increases. This characteristic is experimentally determined so that emission of noxious components of exhaust gas, i.e. HC and CO, do not increase, and good drivability is maintained.

However, the initial value of the post startup increase coefficient KAS is determined according to engine cooling water temperature during startup, and no account is taken of how much deposited fuel remains in the intake passage and intake valve when startup is completed. Consequently, the initial value of KAS may be too large or too small depending on the time taken for the engine to start, increasing emission of HC or CO and adversely affecting drivability.

For example, when engine startup is completed in a short time, the fuel amount injected during startup is less, and the amount of fuel deposit when startup is completed is less than the equilibrium fuel deposit amount. The equilibrium fuel deposit amount is the amount of fuel deposited when the vehicle is running under steady state conditions, and this amount depends on the temperature of the part where fuel is deposited. When engine startup 1s completed in a short time, therefore, a considerable part of the fuel injected immediately after startup is completed, deposits on the wall surfaces of the intake passage or intake valve. It is thus necessary to set the initial value of KAS large.

On the other hand, when a long time is required for startup, more deposited fuel remains when startup is complete than the set value, and if the initial value of KAS is set large as in the aforesaid case, the fuel injection amount is excessive so that emission of HC and CO increases.

SUMMARY OF THE INVENTION

It is therefore an object of this invention to control fuel injection amount after startup is complete based on a fuel deposit amount when startup is complete.

In order to achieve the above object, this invention provides an air-fuel ratio controller for use with an engine which has a combustion chamber, an intake passage for aspirating air to the combustion chamber and an injection valve for injecting fuel into the air in the passage whereby a fuel-deposited part is formed in the passage. The controller comprises a mechanism for estimating a temperature of the fuel-deposited part during engine startup, a mechanism for summing fuel amounts injected by the injection valve during engine startup, a mechanism for computing an intake rate of the injected fuel to the combustion chamber based on the temperature of the fuel-deposited part, a mechanism for estimating a fuel deposition amount on the fuel-deposited part when startup is complete based on the intake rate and the injected fuel amount during startup, a mechanism for computing a post startup fuel injection amount according to the fuel deposition amount, and a mechanism for supplying fuel to the injection valve corresponding to the post startup fuel injection amount.

If the engine is water-cooled, it is preferable that the controller further comprises a mechanism for detecting a cooling water temperature, and the post startup fuel injection amount computing mechanism comprises a mechanism for computing a first post startup increase coefficient according to the cooling water temperature during startup and the elapsed time from completion of startup, a mechanism for computing a second post startup increase coefficient according to the fuel deposition amount when startup is complete, a mechanism for computing a final post startup increase coefficient from the second post startup increase coefficient and the first post startup increase coefficient, and a mechanism for determining the post startup injection mount based on the final post startup increase coefficient.

The second post startup increase coefficient computing mechanism preferably comprises a mechanism for setting an initial value based on the fuel deposition amount when startup is complete, and a mechanism for computing the second post startup increase coefficient from this initial value and a predetermined time constant.

The second post startup increase coefficient computing mechanism preferably further comprises a mechanism for varying the time constant according to the temperature of the fuel-deposited part when startup is complete.

The details as well as other features and advantages of this invention are set forth in the remainder of the specification and are shown in the accompanying drawings.

DESCRIPTION OF THE PREFERRED EMBODIMENTS

Figure 1:
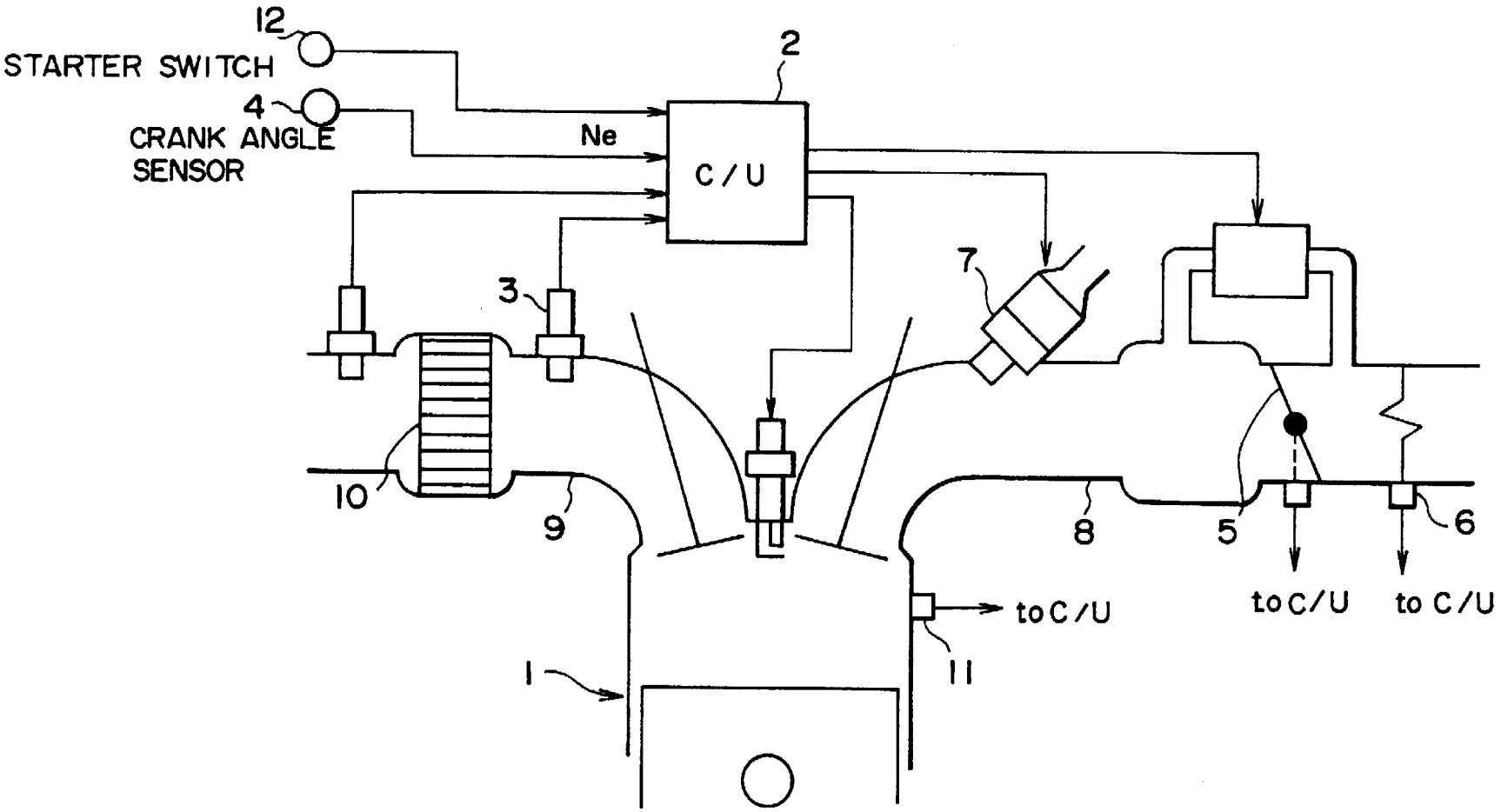
FIG. 1 is a schematic diagram of an air-fuel ratio controller according to this invention.

Referring to FIG. 1 of the drawings, an engine 1 is provided with an intake air passage 8 and an exhaust passage 9. A throttle 5 for regulating an intake volume and a fuel injection valve 7 for injecting fuel into the intake air are provided in the passage 8, the valve 7 being situated downstream from the throttle 5. The fuel injection amount delivered by the valve 7 corresponds to an injection pulse signal output by a control unit 2. An air flow meter 6 for detecting an intake air amount is provided upstream from the throttle 5.

A catalytic converter 10 for purifying exhaust gas is installed in the exhaust passage 9. An oxygen sensor 3 that detects an air-fuel ratio from the oxygen concentration of the exhaust gas upstream from the catalytic converter 10 is also provided in the passage 9.

The engine 1 is further provided with a water temperature sensor 11 for detecting cooling water temperature, a crank angle sensor 4 and a starter switch 12. The crank angle sensor 4 outputs a reference position signal (REF) corresponding to a predetermined reference rotation position of a crankshaft, and an angle signal (POS) corresponding to an incremental rotation angle.

The REF and POS signals are input to the control unit 2 together with an intake air volume signal from the air flow meter 6, air-flow ratio (oxygen concentration) signal from the oxygen sensor 3, cooling water temperature signal from the water temperature sensor 11 and starter signal from the starter switch 12.

Based on these signals, the control unit 2 controls the fuel injection amount of the fuel injection valve 7.

First, when the starter signal is ON, i.e. when the starter is rotating, a startup injection pulse width TST is determined according to the startup water temperature. The startup water temperature is the cooling water temperature when the ignition switch is ON, and the startup injection pulse width TST is the pulse width of an injection pulse signal output to the fuel injection valve 7 when the engine is starting up. The startup injection pulse width TST is first determined by experiment according to the startup water temperature in order to obtain good startup conditions. These values are stored as a table in a memory of the control unit 2. When an ON signal is input from the starter, this table is searched based on the startup cooling water temperature, and a fuel amount corresponding to the searched startup injection pulse width TST is injected.

When startup is completed and the starter signal goes OFF, the control unit 2 calculates a basic injection pulse width Tp from an intake air volume Q detected by the air flow meter 6 and an engine speed detected by the crank angle sensor 4 using the relation $$Tp = \frac{k \cdot Q}{N}$$

where k is a constant.

A fuel injection pulse width Ti is then determined from the following relation:

$$Ti = Tp \cdot COEF \cdot \alpha + Ts$$

where COEF represents various increase coefficients including a water temperature increase coefficient KTW, the post startup increase coefficient KAS and a mixing ratio coefficient KMR, $\alpha$ is an air-fuel ratio feedback correction coefficient computed based on the oxygen sensor output, and Ts is a pulse width depending on the battery voltage to compensate an ineffective part of the operation of the fuel injection valve.

The initial value of the aforesaid post startup increase coefficient KAS is determined according to the startup water temperature. It decreases at a fixed rate with elapsed time after startup is completed, i.e. with elapsed time after the starter signal changes from ON to OFF, and finally reaches 0. After engine startup is completed, the post startup increase coefficient KAS is multiplied by Tp. If this value is made larger, the injection amount increases so that the air-fuel ratio becomes richer, combustion is stabilized, and good drivability is obtained, however if the air-fuel ratio is made too rich, combustion is then unstable and drivability is impaired. When the engine is cold, much of the injected fuel deposits in the intake passages, intake ports or intake valves, and this deposited fuel does not enter the combustion chamber for some time. Moreover, as the temperature of fuel-deposited parts such as intake passage walls and valves is low, lit fie of this deposited fuel evaporates. This means that less fuel enters the combustion chamber than the amount that was injected. Still further, if the air volume aspirated in the combustion chamber increases sharply due to rapid opening of the throttle 5 when the temperature of the fuel-deposited parts is low, the fuel amount aspirated into the combustion chamber may temporarily be insufficient for the air volume due to delay in movement of the deposited fuel. Due to this situation, a fuel increase correction is normally applied via KAS to prevent the air-fuel ratio becoming too lean.

However if the initial value of KAS is determined only according to the startup water temperature, since the deposited fuel mount varies with the time taken for the engine to start, the initial value of KAS may be too large or too small, leading to increased emission of HC or CO and impairing drivability.

According to this invention, in order to compute a startup fuel injection mount, a combustion chamber fuel intake rate, i.e., a ratio of fuel injected to fuel which has reached to the combustion chamber during startup is calculated according to the temperature of the fuel-deposited parts. A deposited fuel mount when startup is completed is then estimated based on this intake rate and computed fuel injection amount, and the post startup fuel increase coefficient is corrected according to this estimated value.

The conventional post startup increase coefficient KAS is therefore represented herein as a first post startup increase coefficient $KAS_1$, and a second post startup increase coefficient $KAS_2$ which corrects $KAS_1$ is newly introduced. The sum of these two increase coefficients is set as the final post startup increase coefficient KAS, and the second increase coefficient $KAS_2$ is increased or decreased using the aforesaid estimated value of the deposited fuel mount.

The control process performed by the control unit 2 will now be described with reference to flowcharts.

Figure 2:
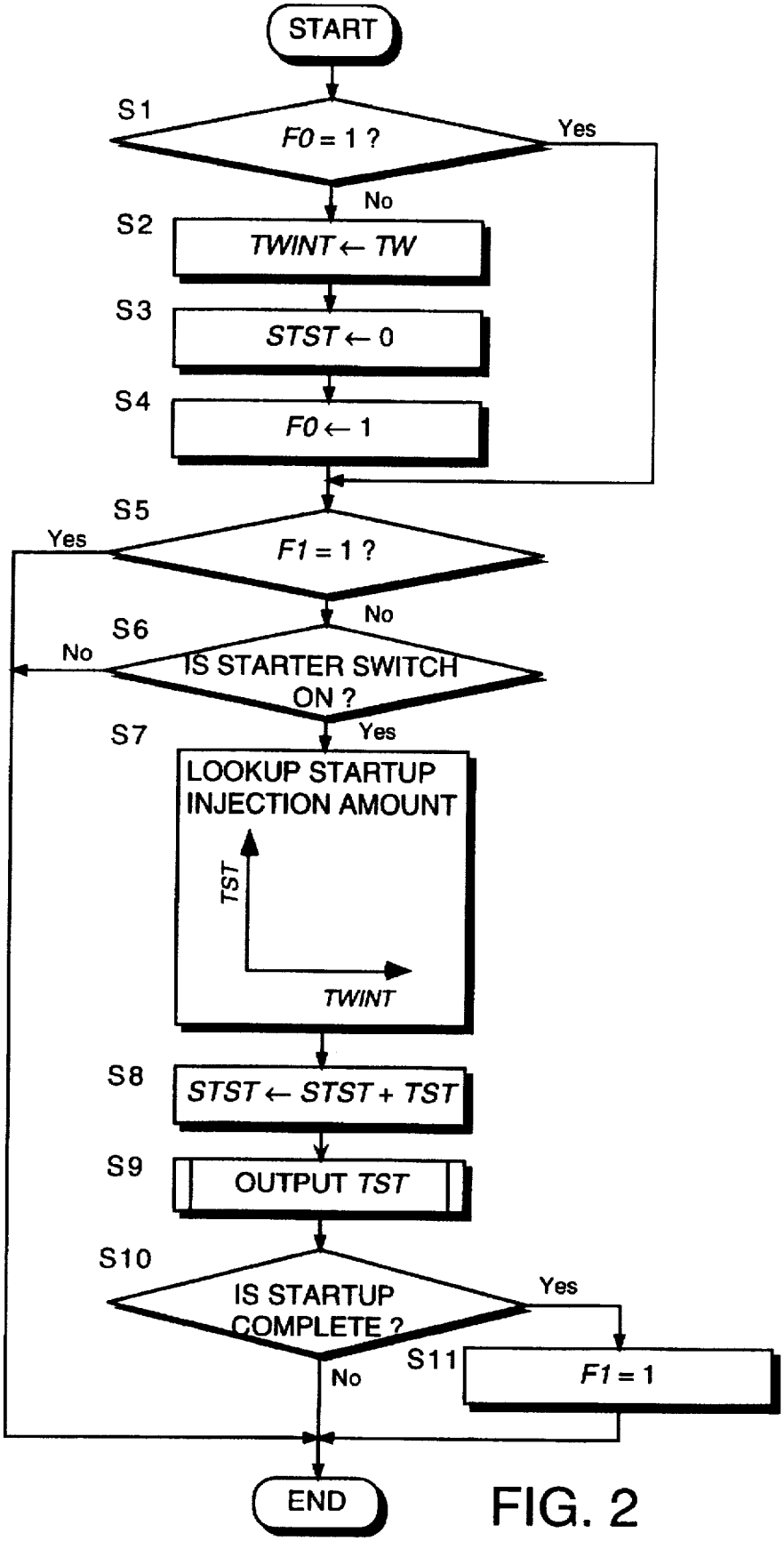
FIG. 2 is a flowchart describing a fuel injection control process during engine startup according to this invention.

FIG. 2 shows a startup fuel injection routine. This routine is performed once every revolution of the engine, and the startup injection pulse TST is output. This routine begins to execute at the time when the starter signal changes from OFF to ON.

First, in a step S1, it is determined from a flag F0 whether or not this is the first time the routine is being performed. The initial value of the flag F0 is "0". When F0=0, i.e. when the routine is being performed for the first time, the routine proceeds to a step S2 where the cooling water temperature TW is read as a startup water temperature TWINT, and the total sum STST of startup injection pulse widths is cleared in a step S3.

In a step S4, "1" is substituted in the flag F0. This indicates that this routine has been performed before, so that if the routine should return to the step S1, it will skip the steps S2, S3, S4 and proceed straight to the step S5. As a result, the startup water temperature TWINT is stored in the memory until startup is repeated.

In the step S5, a flag F1 is determined denoting whether or not startup is complete. The initial value of the flag F1 is 0 indicating that startup is not complete. When F1=0, the routine proceeds to a step S6 where it is determined whether the starter signal is ON or OFF.

When the starter signal is ON, the routine proceeds to a step S7 where the startup injection pulse width TST is found from a startup water temperature TWINT by referring to a predetermined table. Then, the startup injection pulse width TST is added to the sum total STST in a step S8, and an injection pulse signal corresponding to the pulse width TST is output to the fuel injection valve in a step S9.

In a step S10, it is determined whether or not startup is complete, i.e. whether or not the engine has started. This determination is performed for example by determining whether or not the engine speed N is greater than a predetermined value. If startup is not yet complete in the step S10, the routine returns to the beginning and output of TST is repeated. When startup is complete, the routine proceeds to a step S11, the flag F1 for determining startup completion is set to "1" and this routine is terminated.

In this way, TST is output on a plurality of occasions until startup is complete, and the total value of this TST is stored in the memory as the sum total STST.

Figure 3:
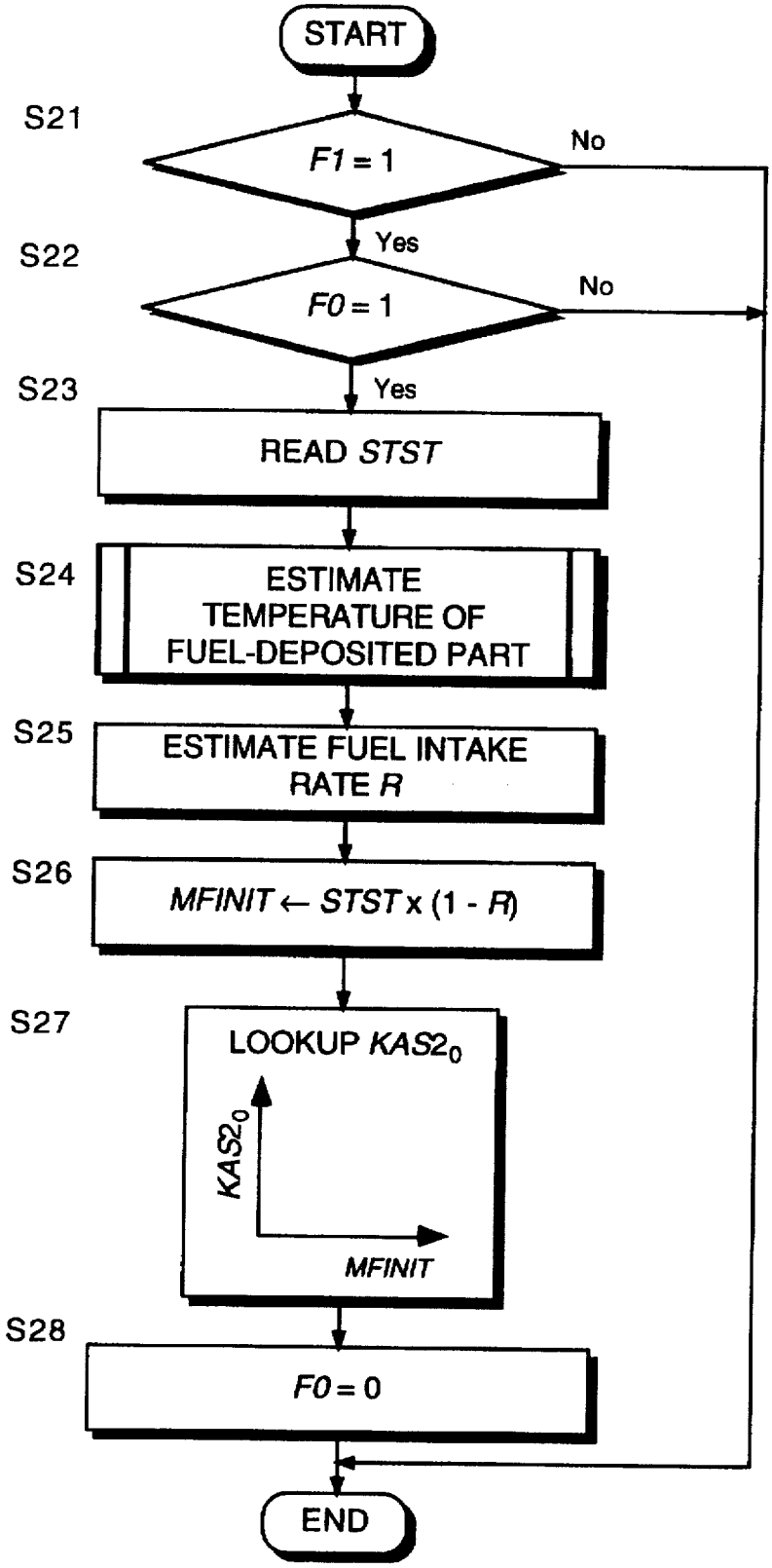
FIG. 3 is a flowchart describing a process for computing an initial value of a post startup increase correction coefficient $KAS_2$ according to this invention.

The flowchart of FIG. 3 shows a routine for computing the initial value $KAS2_0$ of the second post startup increase coefficient.

First, in steps S21, S22, the two flags F1, F0 are determined and when F1=1 and F0=1, it is determined that startup is complete, the routine proceeds to a step S23 and the sum total STST is read.

In a step S24, the temperature of fuel-deposited parts such as the walls of the intake passage and intake ports is estimated. For this purpose, a map for defining the relation between the startup water temperature TWINT and temperature of fuel-deposited parts is previously prepared and stored in the memory of the control unit 2, then estimated values are searched from this map based on the startup water temperature TWINT. Alternatively, the engine cooling characteristic may be found by experiment, and the temperature of fuel-deposited parts when the engine is restarted may be estimated from the elapsed time since the engine stopped and this cooling characteristic. These estimated values may further be modified according to the external temperature. Such a method of determining the temperature of fuel-deposited parts is disclosed for example in Tokkai Hei 7-54689 published by the Japanese Patent Office in 1995.

In a step S25, an intake rate R of injected fuel during startup is estimated from the startup temperature of fuel-deposited parts. The relation between the startup temperature of fuel-deposited parts and the intake rate R is for example first found by calculation or experiment from the fuel spray angle or shape of the intake ports, and stored as a map in the memory of the control unit 2.

When the volatility of the fuel, i.e. whether the fuel is heavy or light, is taken into consideration, different maps are selectively used according to the fuel type. This determination of whether the fuel is heavy or light may be performed using a variety of fuel sensors.

In a step S26, a deposited fuel amount MFINIT remaining on the walls of the intake ports and intake valves immediately after startup Is complete, may be computed from the intake rate R and sum total STST found as described hereinabove using the following relation.

$$MFINIT=STST\cdot(1-R)$$

In this equation, the value obtained by multiplying STST which is the sum total of fuel injection amounts during startup by the intake rate R, is the part of the injected fuel that is actually taken into the combustion chamber, the remainder being the fuel that has been deposited when startup is complete.

Figure 4:
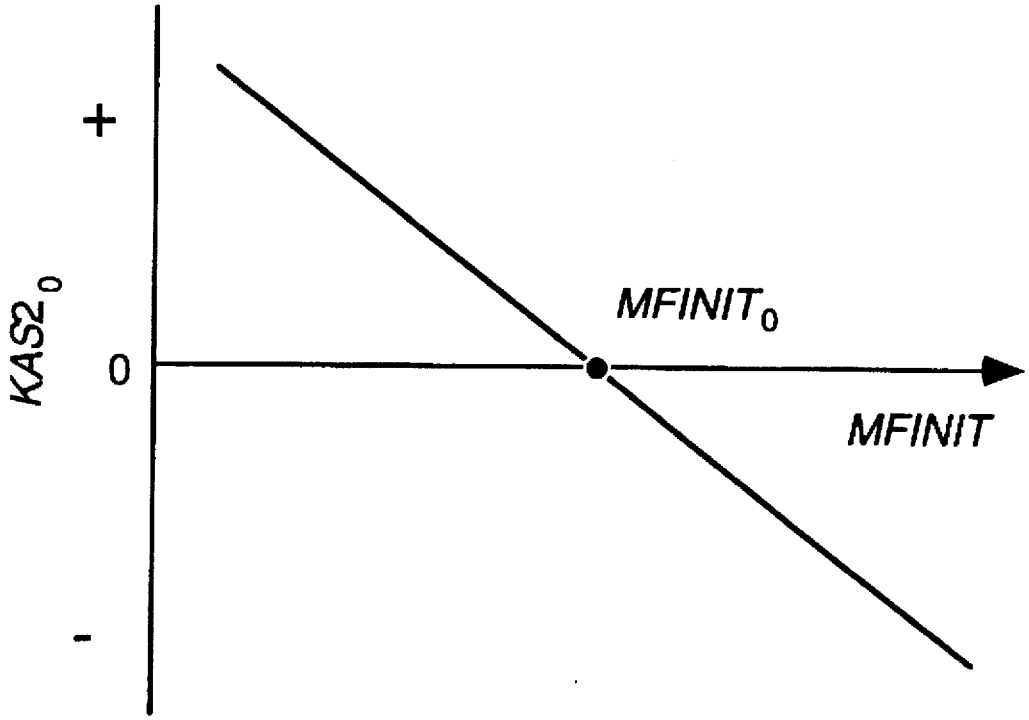
FIG. 4 is a diagram showing the characteristics of an initial value $KAS2_0$ corresponding to a post startup deposited fuel amount MFINIT according to this invention.

In a step S27, the initial value $KAS2_0$ of the second post startup increase coefficient is computed from this deposited fuel amount MFINIT. As shown in FIG. 4, if the value of $KAS2_0$ is taken as 0 for a predetermined value $MFINIT_0$, its value is negative when MFINIT is larger, and positive when on the other hand MFINIT is less than the reference value. For example, when the time taken for startup is longer than a predetermined time due to scatter, MFINIT is larger than $MFINIT_0$. This means that the deposited fuel amount when startup is complete is larger than a predetermined value, so KAS1 is decreased by expressing the excess in terms of KAS2 as a negative value. More specifically, the optimum value of $KAS2_0$ is first measured by experiment, stored as a map in the memory, and the map is searched based on the deposited fuel amount MFINIT so as to find $KAS2_0$.

In a step S28, the flag F0 is reset to "0".

Figure 5:
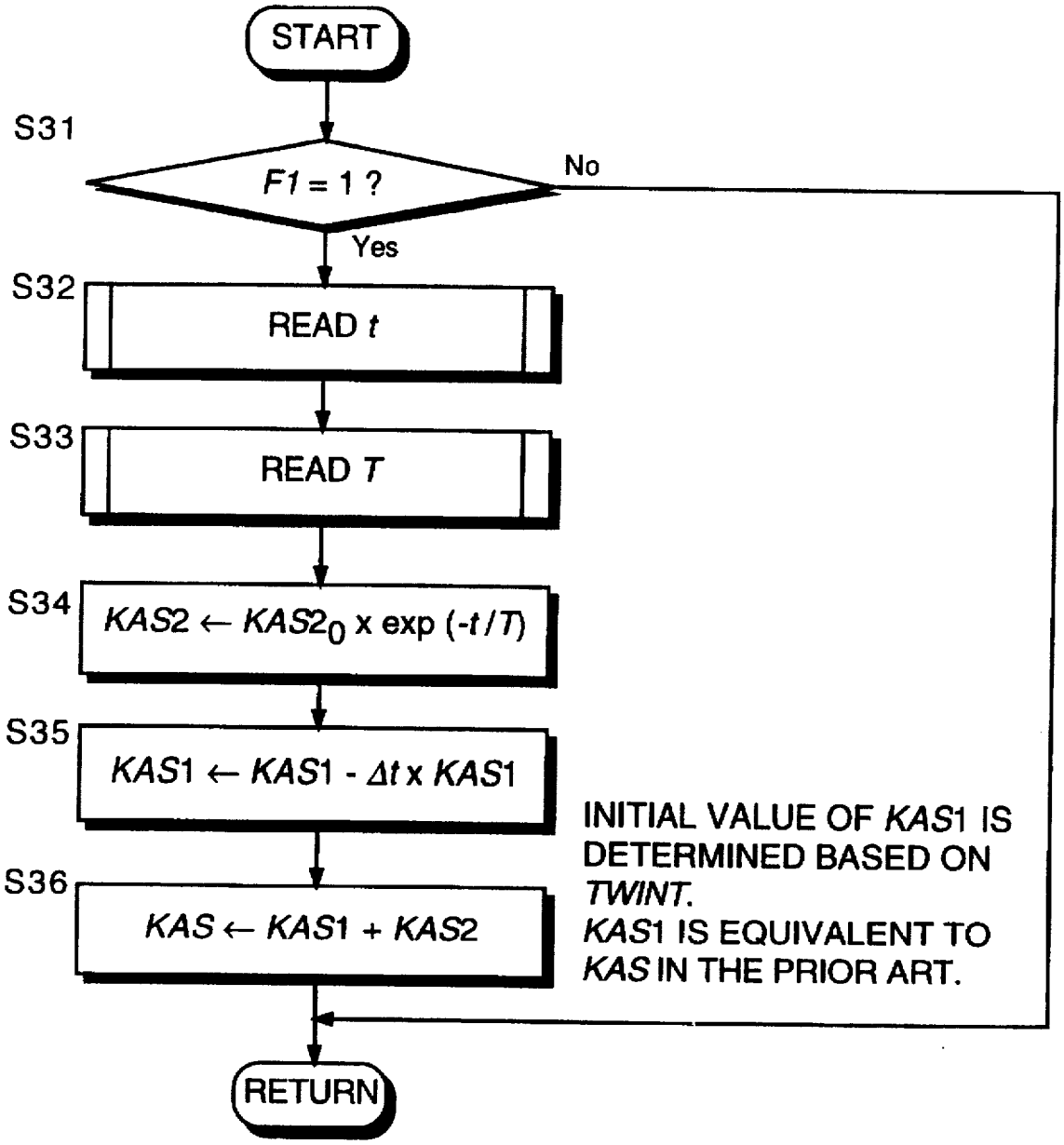
FIG. 5 is a flowchart describing a process for computing a post startup increase correction coefficient KAS according to this invention.

FIG. 5 shows a routine for computing the post startup increase coefficient KAS.

First, it is determined in a step S31 whether startup is complete from the flag F1. When F1=1 meaning that startup is complete, the routine proceeds to a step S32 and subsequent steps. In this routine the initial value $KAS2_0$ of the routine of FIG. 3 is used, however in course of this routine it is not determined whether or not the initial value $KAS2_0$ has been found. The execution sequence of routines in the control unit 2 is therefore predetermined such that the routine of FIG. 3 is executed prior to the routine of FIG. 5.

In a step S32, an elapsed time t from startup completion is read, and in a step S33 a time constant T for decreasing KAS2 is read. In a step S34, the second post startup increase coefficient KAS2 is computed from these values using the following relation.

$$KAS2 = KAS2_0 \cdot \exp\left(\frac{-t}{T}\right)$$

KAS2 is a value for correcting the fuel injection amount after startup is complete according to an excess or insufficiency of injected fuel during startup, and it is therefore desirable that KAS2 is also made to decrease as the part of the fuel injected during startup which deposits on the walls of the intake passage, intake ports and intake valves, decreases. The manner in which KAS2 decreases is therefore expressed by the time constant T, i.e., the decrease of deposited fuel from completion of startup is approximated to a first order delay and KAS2 is also made to vary with a first order delay correspondingly.

In a step S35, the first post startup increase coefficient KAS1 is found. KAS1 is equivalent to KAS of the prior art. Its initial value is determined by the startup water temperature TWINT, and after startup is complete, its value is made to decrease with the elapsed time.

In a step S36, the sum of these two post startup increase coefficients, KAS1 and KAS2, is calculated as the final post startup increase coefficient KAS.

Figure 6:
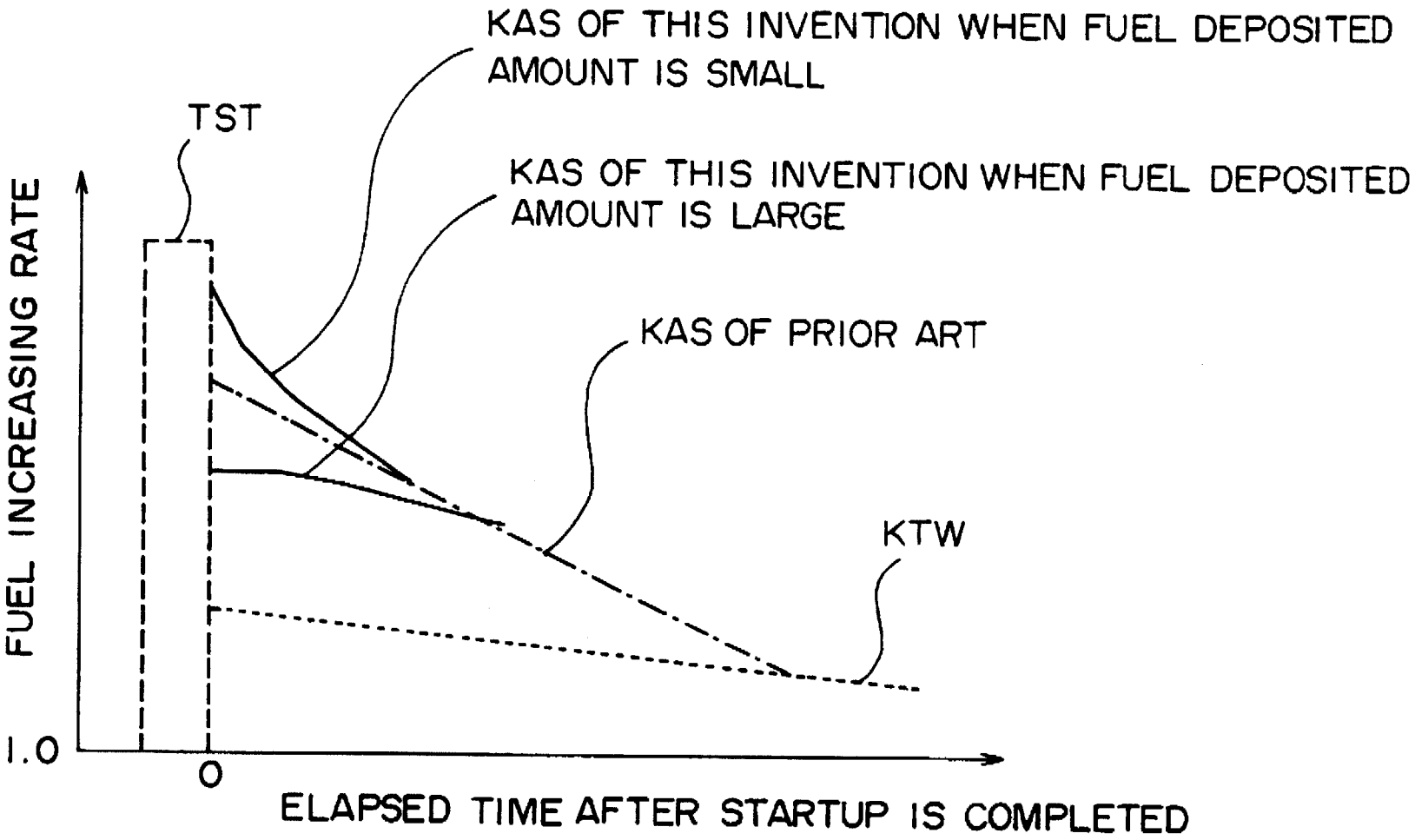
FIG. 6 is a graph describing a variation of the post startup increase correction coefficient KAS according to this invention.

FIG. 6 shows a temporal variation of fuel increase rate based on Tp when this final post startup increase coefficient KAS is applied.

When startup takes a longer time than a set time due to scatter in the time taken to start the engine, the deposited fuel amount MFINIT at completion of startup is lager than the predetermined value $MFINIT_0$, and if it were attempted to increase Tp only by the first post startup increase coefficient KAS1, fuel would be in oversupply and emission of HC and CO would increase.

However according to this invention, as the deposited fuel mount MFINIT at completion of startup is greater than the predetermined value $MFINIT_0$, a negative value of KAS2 is computed. The final post startup increase coefficient KAS which is the sum of this KAS2 and KAS1, is less than the KAS of the prior art as shown in FIG. 6. It is therefore unlikely that a fuel oversupply will occur, and emission of HC and CO do not increase even when startup takes a long time.

On the other hand, when startup is mediate, the deposited fuel amount when startup is complete is less than the predetermined value $MFINIT_0$, and if Tp were increased only by the first post startup increase coefficient KAS1, fuel would be in undersupply and drivability would be impaired.

However according to this invention, as the deposited fuel amount MFINIT at completion of startup is less than the predetermined value $MFINIT_0$, a positive value of KAS2 is computed. The final post startup increase coefficient KAS which is the sum of KAS2 and KAS1 is larger than the KAS of the prior art as shown in FIG. 6. The post startup fuel increase is therefore adequate, and drivability after startup is complete is not impaired even when startup takes a short time.

According to this embodiment, the aforesaid time constant T was taken to be a fixed value, however it need not be fixed and may be used to derive other experimentally determined characteristics. For example, the time constant T may be taken as a parameter of the temperature of fuel-deposited parts. In this case, when it is difficult to estimate the variation of temperature of fuel-deposited parts, the time constant T may be increased according to the elapsed time, and the rate of increase found experimentally.

Accordingly, although the present invention has been shown and described in terms of the preferred embodiment thereof, It is not to be considered as limited by any of the perhaps quite fortuitous details of said embodiment, or of the drawings, but only by the terms of the appended claims, which follow.

We claim:

1. An air-fuel ratio controller for use with an engine, said engine having a combustion chamber, an intake passage for aspirating air to said combustion chamber and an injection valve for injecting fuel into the air in said passage whereby a fuel-deposited part is formed in said passage, comprising:

means for estimating a temperature of said fuel-deposited part during engine startup, means for summing fuel amounts injected by said injection valve during engine startup, means for computing an intake rate of said injected fuel to said combustion chamber based on said temperature of said fuel-deposited part, means for estimating a fuel deposition amount on said fuel-deposited part when startup is complete based on said intake rate and said injected fuel amount during startup, means for computing a post startup fuel injection amount according to said fuel deposition amount, and means for supplying fuel to said injection valve corresponding to said post startup fuel injection amount.

2. An air-fuel ratio controller as defined in claim 1, wherein said engine is water-cooled, said controller comprises means for detecting a cooling water temperature, and said post startup fuel injection amount computing means comprises means for computing a first post startup increase coefficient according to said cooling water temperature during startup and the elapsed time from completion of startup, means for computing a second post startup increase coefficient according to said fuel deposition amount when startup is complete, means for computing a final post startup increase coefficient from said second post startup increase coefficient and said first post startup increase coefficient, and means for determining said post startup injection amount based on said final post startup increase coefficient.

3. An air-fuel ratio controller as defined in claim 2, wherein said second post startup increase coefficient computing means comprises means for setting an initial value based on said fuel deposition amount when startup is complete, and means for computing said second post startup increase coefficient from this initial value and a predetermined time constant.

4. An air-fuel ratio controller as defined in claim 3 wherein said second post startup increase coefficient computing means further comprises means for varying said time constant according to the temperature of said fuel-deposited part when startup is complete.

* * * * *

UNITED STATES PATENT AND TRADEMARK OFFICE

CERTIFICATE OF CORRECTION

PATENT NO. : 5,634,449

DATED : June 3, 1997

INVENTOR(S) : Mikio MATSUMOTO et al.

It is certified that error appears in the above-indentified patent and that said Letters Patent is hereby corrected as shown below:

On the title page, item [30] should be added as follows:

--[30] Foreign Application Priority Data

Mar. 20, 1995 [JP] Japan .....7-60781--

Signed and Sealed this

Fifth Day of August, 1997

Bruce Lehman

*Attest:*

BRUCE LEHMAN

*Attesting Officer*

*Commissioner of Patents and Trademarks*